United States Patent [19]

Igarashi

[11] 3,992,578

[45] Nov. 16, 1976

[54] YOKE MOUNTING APPARATUS

[75] Inventor: Shigeru Igarashi, Kitchener, Canada

[73] Assignee: General Instrument of Canada Ltd., Canada

[22] Filed: Jan. 8, 1976

[21] Appl. No.: 587,862

[52] U.S. Cl. ..... 178/7.8; 178/7.81; 355/210

[51] Int. Cl.[2] ..... H01F 1/00

[58] Field of Search ..... 178/7.8, 7.81, 7.91, 178/7.9; 355/210

[56] References Cited

UNITED STATES PATENTS

| | | | |
|---|---|---|---|
| 3,602,853 | 8/1971 | Cummings | 178/7.81 |
| 3,906,419 | 9/1975 | Bissinger | 178/7.81 |

*Primary Examiner*—Robert L. Richardson
*Assistant Examiner*—Edward L. Coles

[57] ABSTRACT

A yoke mounting apparatus for adjustably positioning a yoke relative to a cathode ray tube and maintaining it in position until it is secured to the tube. The yoke is fastened to an elongated member rotatably mounted on a positioning means that can be moved along three orthogonal axes. A tilting mechanism supporting the tube allows tilting of the tube relative to the yoke. A locking means normally prevents any movement between the yoke and tube. A pneumatic source is used to release only that lock preventing the type of movement desired. All the controls for the apparatus are mounted at the front of the tube so the tube screen can be viewed while the relative positions of the yoke and tube are adjusted.

39 Claims, 12 Drawing Figures

HOR TILT
VERT TILT
ROTATE
ROT
Z
Y
X 121
125
114
74
72
74
124
68
70
116
70
114
77
115
98
106
95
76
112
66
C
70
70
62
114
62
115
116
60
64
64
56
58
58
54
56
52
52
102
92
80
48
46
46
96
86
E
94
Y
84
44
44
X
X
88
80
78
Z
40
Y 8
10
12
14
16
18
20
22
24
26
30
32
37
80
94
95
96
98

6
6
8
10
12
14
16
20
22
24
26
28
30
32
34
36
37
80
94
98

VERT. TILT
Z
8
8
2
5
5
36
36'
66
68
76
77
77'
79
79
104
40
120
122
124
124
126
128
130
134
140
142
146
148
150
166
168
174

YOKE MOUNTING APPARATUS

The present invention relates to an apparatus for mounting a deflection yoke to a cathode ray tube by first adjustably positioning the yoke and tube relative to each other until the electron beam is properly aligned and then maintaining the yoke and tube in this relative position until the yoke is rigidly fastened to the tube.

A deflection yoke is required for the proper operation of a cathode ray tube in displaying a visual image. The electron beam emitted by an electron gun at the back of the tube toward the flourescent screen at the front of the tube is deflected by the magnetic field produced by the yoke to one of numerous spots on the screen in accordance with an electric signal. If the yoke is not properly aligned relative to the tube, it will deflect the beam to a wrong spot on the screen causing various undesirable changes in the image. In color television sets, where three electron guns are conventionally employed, such a misalignment results in particular serious color and image distortion. Consequently, proper alignment of the yoke is critical to provide an accurate, pleasing image.

Numerous arrangements have been suggested for adjustment of the yoke relative to the tube. Common to those arrangements providing the precise adjustment required, particularly necessary for color television sets, is their complexity, bulk, and expense. The undesirable features involved with any complex, expensive piece of equipment are readily apparent. Its bulk, however, poses difficulties peculiar to the specific usage to which a yoke mounting apparatus is put. Since television enclosures, or cabinets, are generally little bigger than the tube, yoke position adjustment cannot be done with the tube inside the enclosure if the adjusting mechanism is bulky. Consequently, with prior apparatus the yoke alignment can only be done at an alignment station remote from the enclosure. This poses several difficulties. First, since deflection of the electron beam is sensitive to even slight changes in the surrounding magnetic field or in the electrical characteristics of the circuit to which it and the tube are connected, great care is needed in matching these factors at the yoke aligning station with those present in the enclosure. Additional equipment besides the aligning mechanism is, therefore, required at the station to simulate the electrical and magnetic environment within the enclosure. Second, the simulated environment is effective only up to a point since chances are that it will not identically simulate the environment in which the tube will eventually be placed because television components are made within a certain tolerance. Therefore, once installed in its enclosure and connected to the circuitry, the tube performance, satisfactory in the simulated environment, might not be satisfactory due to variations in the enclosure or the circuitry that are within the tolerance range. Third, the simulated environment, must, of course, be changed for each type of enclosure and circuitry and used having different electrical and/or magnetic characteristics, thus requiring additional equipment as well as labor time to vary the simulated environment. Finally, once the tube with its attached yoke is mounted within the enclosure, all adjustments required in service or in repairs done at the plant producing the television receiver must involve the laborious and time-consuming process of removing the tube and then replacing it.

It is, therefore, a prime object of the present invention to provide a yoke mounting apparatus which can be used to adjust the yoke relative to a tube installed within an enclosure.

Another object of the present invention is to provide an accurate, reliable, relatively simple and relatively inexpensive yoke mounting apparatus.

Yet another object of the present invention is to provide an apparatus for positioning the tube relative to a stationary yoke.

It is still another object of the present invention to provide an apparatus for tilting the tube vertically and horizontally relative to the yoke.

A further object of the present invention is to provide an apparatus providing convenient accessibility to the controls.

In accordance with these objects, a yoke mounting apparatus is provided having a positioning means permitting movement along three orthogonal axes. The yoke is fastened to one end of an elongated member which is rotatably mounted at its other end to the positioning means. The elongated member is easily accommodated within the enclosure to enable adjustment of the yoke relative to a tube mounted in the enclosure while the more bulky positioning means remains outside the enclosure. A tilting mechanism is included to enable a vertical and horizontal tilting of the tube relative to the yoke to compensate for variations in different types of enclosures used. Adjustment of the yoke in any of the six different types of movements just described is normally prevented by a lock associated with each movement. Should a particular movement be necessary, its lock will be released while the other five movements remain locked. A pneumatic source is used to operate the locks.

To the accomplishment of the above and to such other objects as may hereinafter appear, the present invention relates to the construction of a yoke mounting apparatus, as defined in the appended claims and as described in this specification, taken together with the accompanying drawings, in which:

Figure 1:
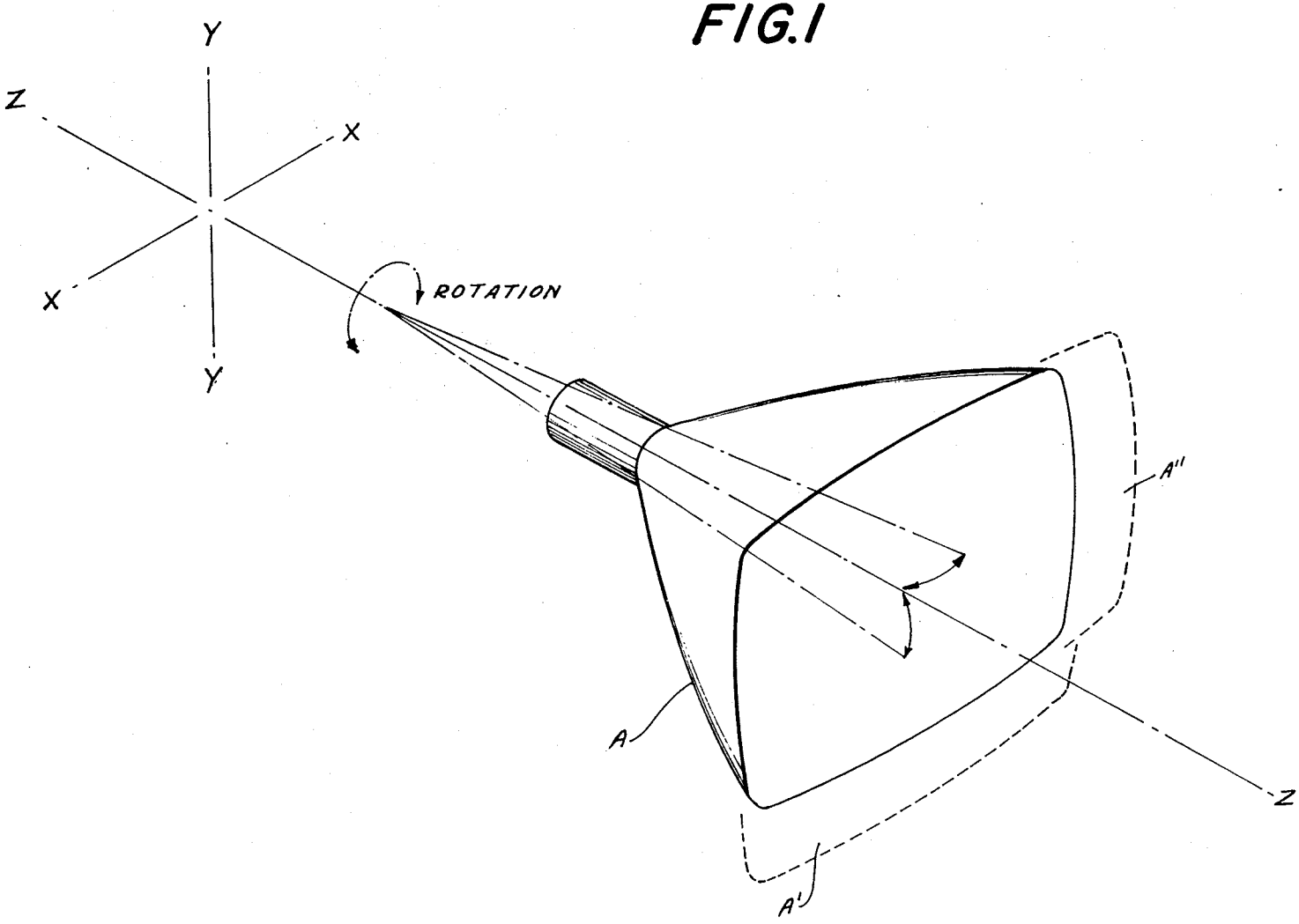
FIG. 1 is a schematic showing of the six different movements possible with the present invention.

In order to provide an accurate visual image an electron beam generated at the back of a cathode ray tube must be precisely deflected to an intended point on a luminescent screen at the front of the tube. This precise deflection can only be attained if the deflection yoke is properly positioned with respect to the tube. Ideally, this relative position could be determined by mathematical calculations and/or laboratory testing and then each deflection yoke could be positioned relative to its corresponding tube in exactly the same manner. However, since all electrical components are by necessity made within certain manufacturing tolerances, the yoke must in reality be slightly adjusted about its ideal location. The most practical way to align the yoke is to connect it and the tube into the proper electrical circuit and have a technician adjust the position of the yoke while viewing the tube screen until the correct image is attained. Adjustment of the yoke can be made relative to the tube A, shown in FIG. 1, in any of the *x*, *y*, and *z* axes as well as by its rotation about the longitudinal axis of the tube which coincides with the *z* axis as shown in FIG. 1. These four kinds of movement are supplemented by two additional ones which are particularly well suited to those applications where different size cabinets and variations in the tube mountings are used with a particular type of tube. In such a situation, it is possible that the *z* axis of the yoke is tilted with respect to the *z* axis of the tube which would cause a distortion of the image. Consequently, a mechanism is provided to enable the vertical tilt of the tube from its dotted position A′ as well as the horizontal tilt from its dotted position A″ to align the respective *z* axes. By viewing the screen while simultaneously adjusting the relative positions of the yoke and the tube, a technician can precisely position the yoke to provide an accurate image on the screen.

To provide the various movements necessary to properly align a yoke and the tube, the apparatus includes an elongated holder B to which the yoke is secured. Yoke holder B is mounted on a positioning mechanism C which enables the rotation of holder B as well as its movement in the *x*, *y* and *z* axes. A tilt mechanism D is located beneath the tube A and allows the tilting of tube A in vertical and horizontal directions. Movement of the holder B and tilting of mechanism D are actuated by a control E. Control E is effective to provide the desired movement only when a locking means F is deactivated by a release means G.

Figure 2:
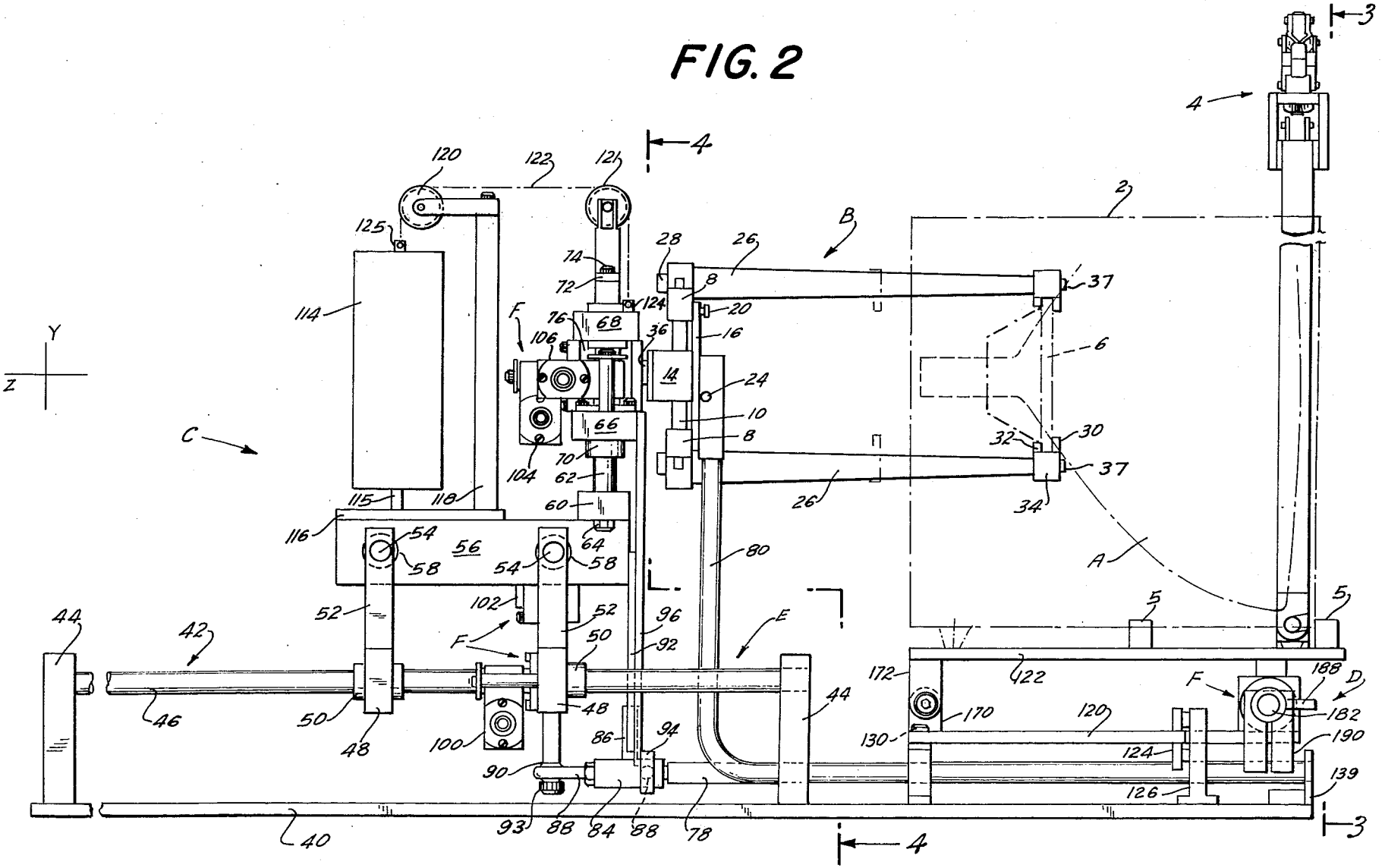
FIG. 2 is a side elevational view of the apparatus.
Figure 6:
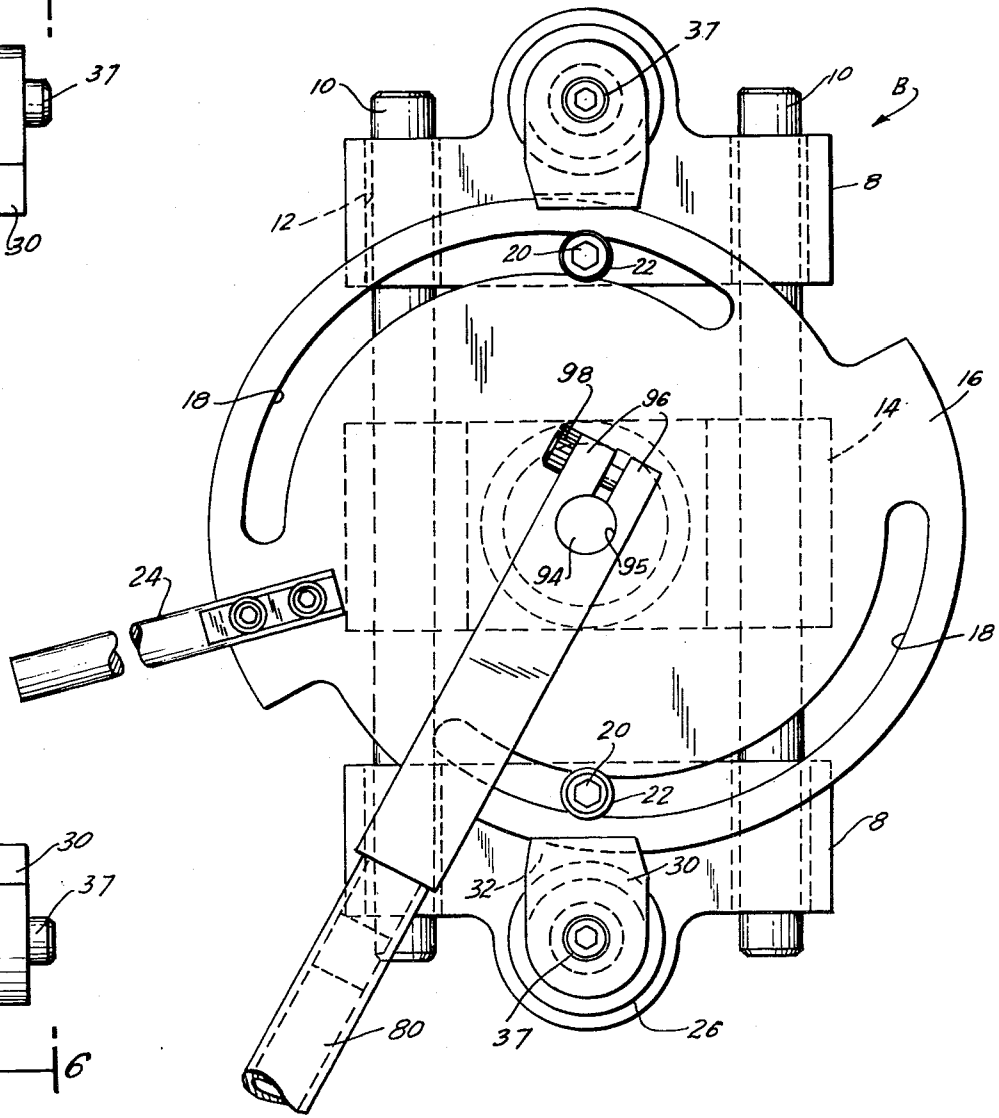
FIG. 6 is a view taken along line 6—6 of FIG. 5.
Figure 5:
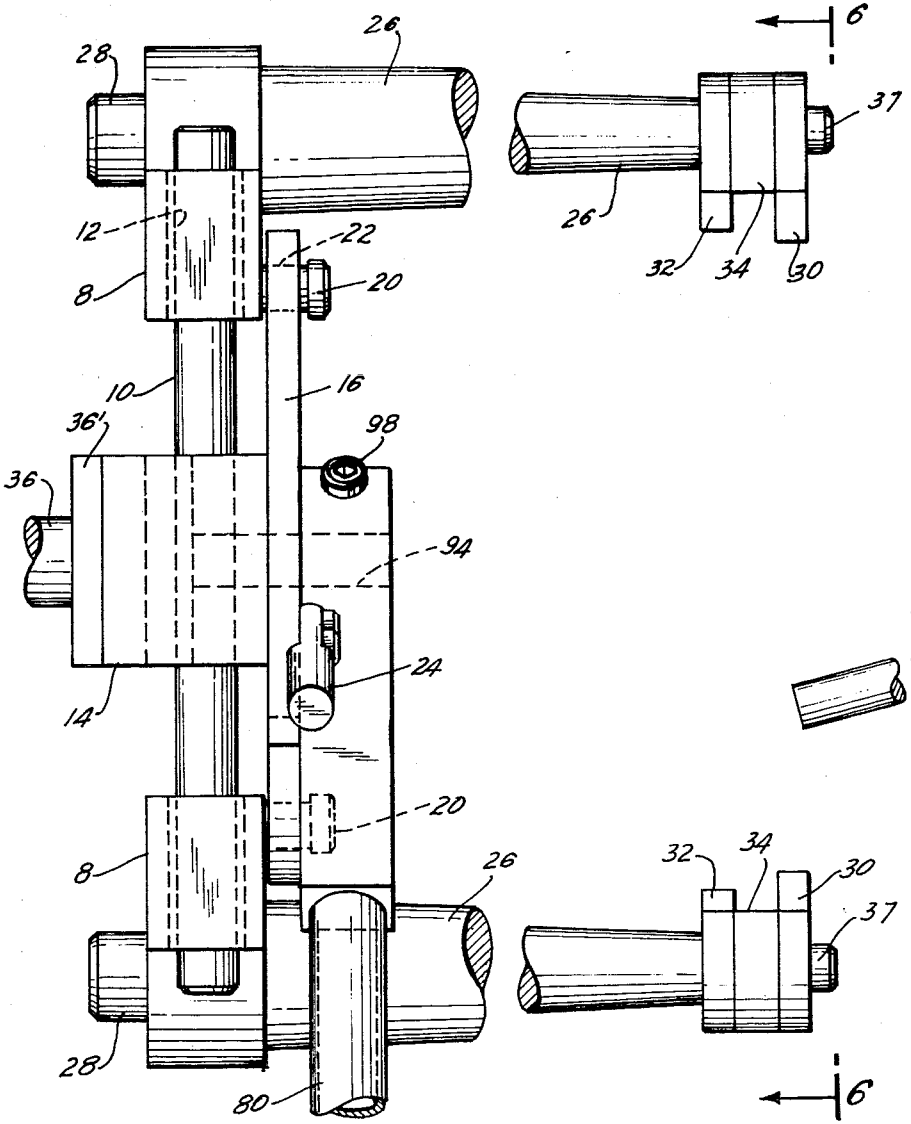
FIG. 5 is an enlarged side view of the rotatable yoke support assembly.
Figures 7, 12:
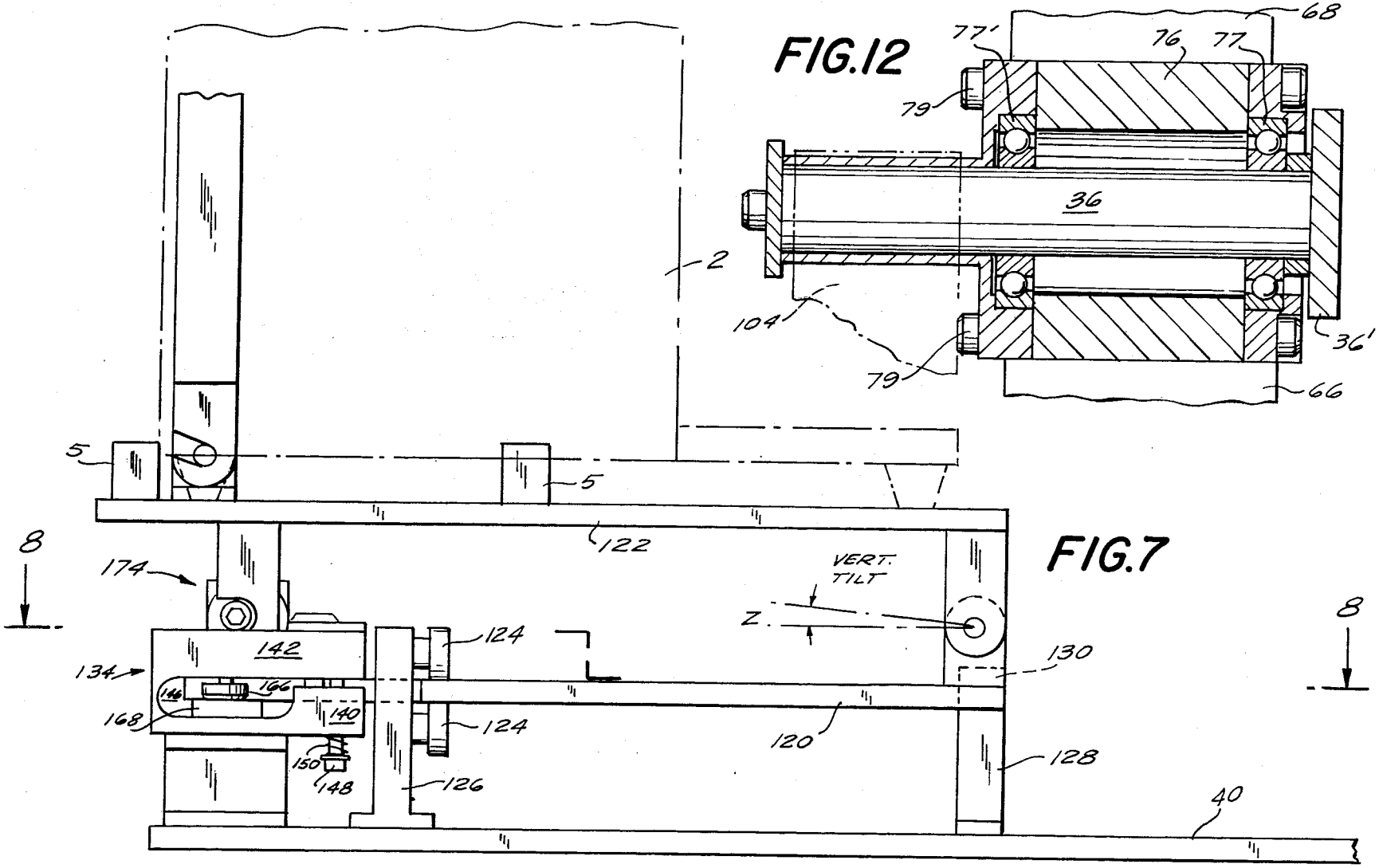
FIG. 7 is an enlarged fragmentary view from the rear of the horizontal and vertical tilt apparatus shown in the lower right hand corner of FIG. 2.
FIG. 12 is an enlarged fragmentary sectional view of the yoke rotational support taken along line 13—13 of FIG. 4.

To more particularly describe the invention, FIG. 2 shows the cathode ray tube A mounted within an enclosure 2 (shown by dotted lines) which is fixedly secured atop tilting mechanism D by a standard clamp 4. Abutments 5 keep the enclosure from sliding off or from being inadvertently pushed off before clamp 4 is tightened. The yoke 6 (shown in dotted lines) is fastened to support B, which is best shown in FIGS. 5 and 6. Support B is comprised of two bars 8 which are slidable vertically along rods 10. Rods 10 fit within holes 12 at each end of bar 8. Bearings may be inserted between rod 10 and bar 8 to facilitate the vertical movement of bars 8 along rods 10. Rods 10 are also received within a bar 14 which is mounted to positioning means C, as described below. To provide for relative movement of bars 8 toward or away from each other an eccentric cam 16 having eccentric arcuate grooves 18 mounted on bars 8. This is done, as best shown in FIG. 6, by inserting screw 20 and a surrounding roller 22 through groove 18 and threading it into each of bars 8. Thus, as the eccentric cam is rotated clockwise bars 8 will be forced apart while rotation of the cam counterclockwise will bring bars 8 toward each other. A handle 24 is screwed to eccentric cam 16 for rotating the cam. The yoke receiving portion of support B is comprised of two elongated rods, or arms, 26 secured to bars 8, respectively. A screw 28 passes through a hole in each of bars 8 and into a corresponding threader hole in rods 26 to securely fasten arm 26 to bar 8. Arms 26 are preferably made of a non-metallic material and are long enough so that the rest of the apparatus, which is metallic for the most part, is sufficiently distant from yoke 6 so as not to appreciably affect the magnetic field controlling the electron beam.

Figure 4:
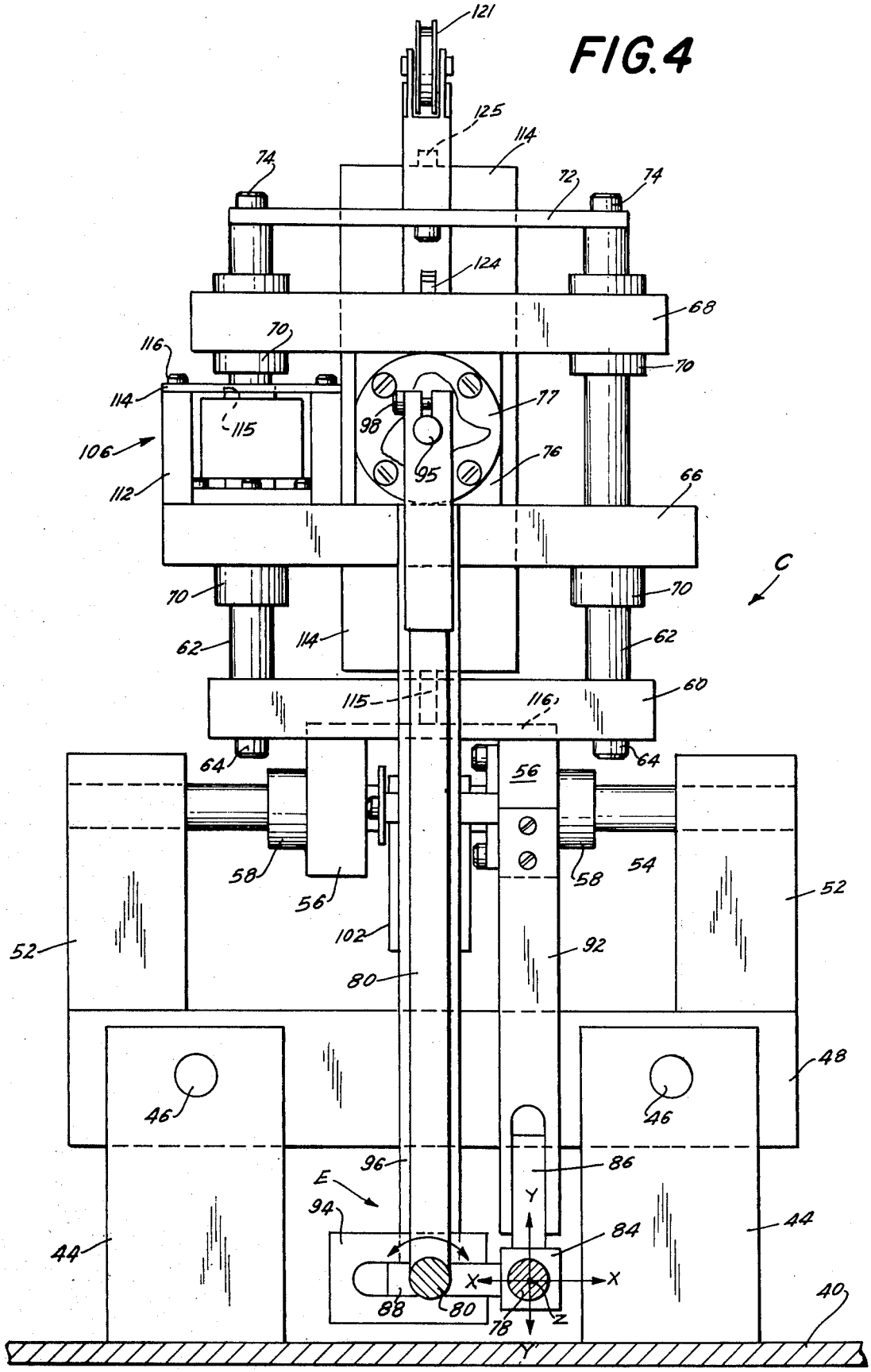
FIG. 4 is a view taken along line 4—4 of FIG. 2.

At the end of rod 26 remote from bar 8, two wedge-shaped members 30 and 32, separated, by a spacer 34, are secured to rod 26 by screw 37. Parts 30 and 32 are shaped to fit into a particular yoke with the wedged portion of part 30 fitting a similarly shaped portion of the yoke. Since these specific structures form no part of the present invention, no additional details are deemed necessary. Suffice it to say that to secure the yoke to holder B, it is aligned with parts 30 so that as the eccentric cam 16 is rotated counterclockwise, as described above, parts 30 will be tightly wedged into the corresponding portions of yoke 6. Holder B is securely fastened to end 36′ of a shaft 36 which is journaled into positioning means C. Shaft 36 is inserted in and secured to bar 14 so that no relative rotation between them is possible. Thus, as the shaft is rotated, bar 14 along with the remainder of holder B rotates accordingly. In the fully assembled apparatus, holder B is not vertical as shown. It is displaced by approximately 30° so that part 80, discussed below, is vertical, as shown in FIG. 4.

As best seen in FIG. 2, holder B is small enough to fit within enclosure 2. In fact, at the portion which enters the enclosure, holder B is only slightly larger than the yoke. Consequently, the clearance between holder B and enclosure 2 is such as to leave sufficient room for maneuvering yoke 6 until it is properly adjusted relative to tube A. The bulkier part of the apparatus, positioning means C, is outside of enclosure 2 and only the compact portion of the apparatus, yoke holder B, needs to be inserted within the enclosure.

Positioning means C is comprised of a carriage 42 having two sets of support bars 44 fastened to base plate 40. Two sliding rods 46 extend between bars 44. The means for attaching parts 40, 42, 44, and 46 to each other are conventional, and, therefore, not shown. Two bars 48 extend between rods 46 and contain bearing 50 and into which rods 46 are inserted. Consequently, bars 48 are free to slide easily along rods 46 in the z direction. Each of bars 48 carries an upwardly extending bar 52 at each end. A slide rod 54 extends between each set of bars 52 on a bar 48. Two bars 56, containing a bearing 58 at each end, extend between sliding rods 54. Thus, bars 56 are free to slide along rods 54 in the *x* direction. At the end of bars 56 nearest to tube A, a bar 60 is attached to and extends laterally of bars 56. Extending vertically from each end of bar 60 are sliding rods 62. A bar 66 and a bar 68 extend between sliding bars 62 with each bar having a bearing holder 70 at each end into which rods 62 are inserted. Thus, bars 66 and 68 are free to slide vertically along sliding rods 62 in the *y* direction. A bar 72 extends between and is attached to each of sliding rods 62 by screws 74. Bar 72 adds rigidity to the assembly of bar 60 and sliding rods 62. A bar 76 is rigidly secured between bars 66 and 68. Shaft 36, which is fastened to yoke support B, is journaled into bar 76 which, therefore, serves as the portion of positioning means C upon which yoke support B is mounted. As best seen in FIG.

12, rotation of shaft 36 is facilitated by bearing holders 77 and 77′ which are attached to bar 76 by screws 79.

From the above description of the apparatus, tube A and positioning means C are both attached to base plate 40 while yoke support B is mounted on positioning means C. Therefore, as a portion of positioning means C is moved relative to base plate 40, it is necessarily moved relative to the tube. Specifically, as bars 52 are moved along rods 46 of carriage 42, the yoke 6 is correspondingly moved along the *z* axis relative to the tube. Similarly, as bars 56 are moved along rods 54, yoke 6 will be moved along the *x* axis. Vertical movement of yoke 6 along the *y* axis is attained as bars 66 and 68 carrying bar 76 are moved along rods 62. Thus, yoke 6 by virtue of its being attached to positioning means C is movable in the *x*, *y* and *z* axes. Furthermore, rotation of yoke 6 is accomplished by rotating shaft 36 within its housing in bar 76 resulting in corresponding rotation of yoke holder B which is rigidly fastened to shaft 36.

The control means E for actuating the linear movement of yoke 6 in the *x*, *y* and *z* axes as well as its rotational movement around the *z* axis is comprised of a tube 78 and a tube 80. As best seen in FIGS. 2 and 4, tube 78 is secured to a bar 84 from which pins 86 and 88 extend vertically, in the y direction, and horizontally, in the *x* axis, respectively. To the other end of bar 84 is attached a member 88 which is adapted to form a ball joint with a bearing 90. Bearing 90 is rigidly fastened to a bar 48 by screw 93. The joint comprised of parts 88 and 90 allows rotation of tube 78 around bearing 90 along either the *x* or the *y* axes. Should it be moved along the *x* axis, pin 86 engages bar 92 which is attached to a bar 56. Thus, bar 92 is only effective to transmit the *x* direction component of motion of tube 78 to bar 56, and that part of the yoke mounting apparatus attached to it so as to move it along the *x* axis. This movement of tube 78 causes pin 88 to slide within a recess in a plate 94 which is attached to bar 66 by means of another bar 96. Consequently, horizontal movement of tube 78 has no effect on bar 96. Should, however, tube 78 be moved vertically, pin 88 engages plate 94 to cause vertical movement of bar 66, and the parts of the apparatus attached to it, corresponding to the movement of tube 78. This vertical movement, however, has no effect on bars 92 and 56 since pin 86 slides within a recess in the bar 92. Movement of tube 78 in the *z* direction is transmitted by bearing 90 and screw 93 to bar 48 to cause its movement, as well as the movement of those parts attached to it, along the *z* axis corresponding to the movement of tube 78. Thus, tube 78 can be used to cause adjustment of yoke 6 relative to tube A in the *x*, *y* and *z* axes. To provide rotational movement of yoke 6, tube 80 is secured to a shaft 94 (see FIG. 5) attached to bar 14 and protruding beyond eccentric cam 16. One end of tube 80, adapted to fit around shaft 94, has a round opening 95 to accommodate shaft 94 and two arms 96. A screw 98 is inserted through one arm 96 and threaded into the other to tightly grip shaft 94 therebetween to provide a secure attachment. Tube 80 has a vertical portion which extends down toward tube 78, and a horizontal portion extending toward the front of tube A. Movement of tube 80 along the *x* axis will cause rotation of yoke support B, and consequently, of yoke 6, around the *z* axis.

Adjustment of yoke 6 in any of the four types of movement discussed immediately above is performed by the technician as he moves tubes 78 and 80 while viewing the screen on tube A. Since tube 78 can provide a variety of movements, it is desirable that the operator carry out only one such movement while maintaining the position of yoke 6 along the other axes locked. Otherwise a movement of tube 78 along, say, the *y* axis might inadvertently cause movement along a *z* axis as well. Similarly, movement of tube 80 to cause rotation of the yoke might inadvertently cause movement of positioning means C along any of axes *x*, *y* or *a*. Consequently, a locking means F is provided to normally lock positioning means F is all four of the types of movements described above and when a particular movement is desired, only that part of the locking means preventing this movement is released.

Figure 11:
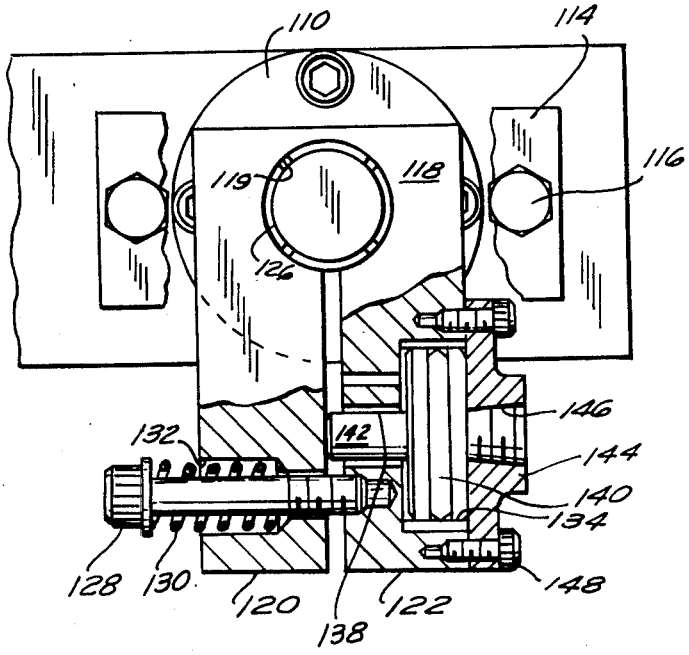
FIG. 11 is a view of the vertical tilt lock taken along line 11—11 of FIG. 3.

Locking means F is comprised of locks 100, 102, 104, and 106. Lock 100 is secured to bar 48 and is adapted to accommodate sliding rod 46. Lock 102 is fixed to a bar 56 and is adapted to accommodate a sliding rod 54. Lock 104 is secured to bar 76 and is adapted to accommodate shaft 36. Lock 106 is secured to bar 66 and is adapted to accommodate sliding rod 62. The structure of these locks, all of which are identical, is best shown in FIG. 11. The body of a typical lock is comprised of a round plate 110 extending between and attached to one end of two elongated protrusions 112 (see lock 106 in FIG. 4). Attached to the other end of parts 112 by screws 116 is a bar 114 having a hole 115 (see FIG. 4) and four compressible fingers 126 extending perpendicularly thereto. A member 118 having a round opening 119 and two extendings arms 120 and 122 is positioned between protrusions 112 and rests on a rod, part of positioning means C, which is inserted into opening 119 and hole 115. The four compressible fingers 126 extend into opening 119 and surround the rod. The extent to which fingers 126 grip the rod depends on the size of opening 119 which, in turn, is dependent on the separation of arms 120 and 122. Thus, rod inserted into opening 119 will be locked in position if arms 120 and 122 are close enough to each other to press fingers 126 firmly against the rod. If, on the other hand, arms 120 and 122 are slightly separated, fingers 126 will expand slightly allowing the rod to slide freely within opening 119. To obtain the locking action, a screw 128 is inserted through a hole in arm 120 and threaded into arm 122. The spring 130 abuts against one end of recess 132 in arm 120 to force arm 120 toward arm 122. The separation between arms 120 and 122 is adjustable by rotation of screw 128. Arm 122 contains a chamber 134 having an opening 138 connecting chamber 134 to the space separating arms 120 and 122. A piston 140 having an attached piston rod 142 is inserted into arm 122 so that piston rod 142 extends through hole 138 to abut against arm 120. A plate 144 having an opening 146 is secured to arm 122 by screws 148. Plate 144 retains the piston in place within chamber 134 and provides an airtight seal. Hole 146 is threaded to accommodate a line (not shown) from a pneumatic power source, such as an air compressor (not shown).

In operation, a sliding rod being within opening 119 of the lock, the screw 128 is adjusted until the rod is firmly gripped by fingers 126. In this state, movement of the apparatus to which the lock is attached relative to the rod is prevented. To release the lock, compressed air is admitted into chamber 134 to move piston 140 in the direction to cause piston rod 142 to increase the separation between fingers 120 and 122 and to compress spring 130. This increased separation will relieve the pressure on fingers 126 which will release the rod and allow free sliding movement of the attached apparatus. Normally all of locks 100, 102, 104, 106 grip the corresponding rod to completely lock positioning means C in place. When a particular movement is desired, release means G must be actuated to unlock one of these locks, the other of the locks remaining in their normal state of gripping the corresponding rod. Thus, inadvertent movement of positioning means C, and therefore of yoke 6, is prevented.

Figure 3:
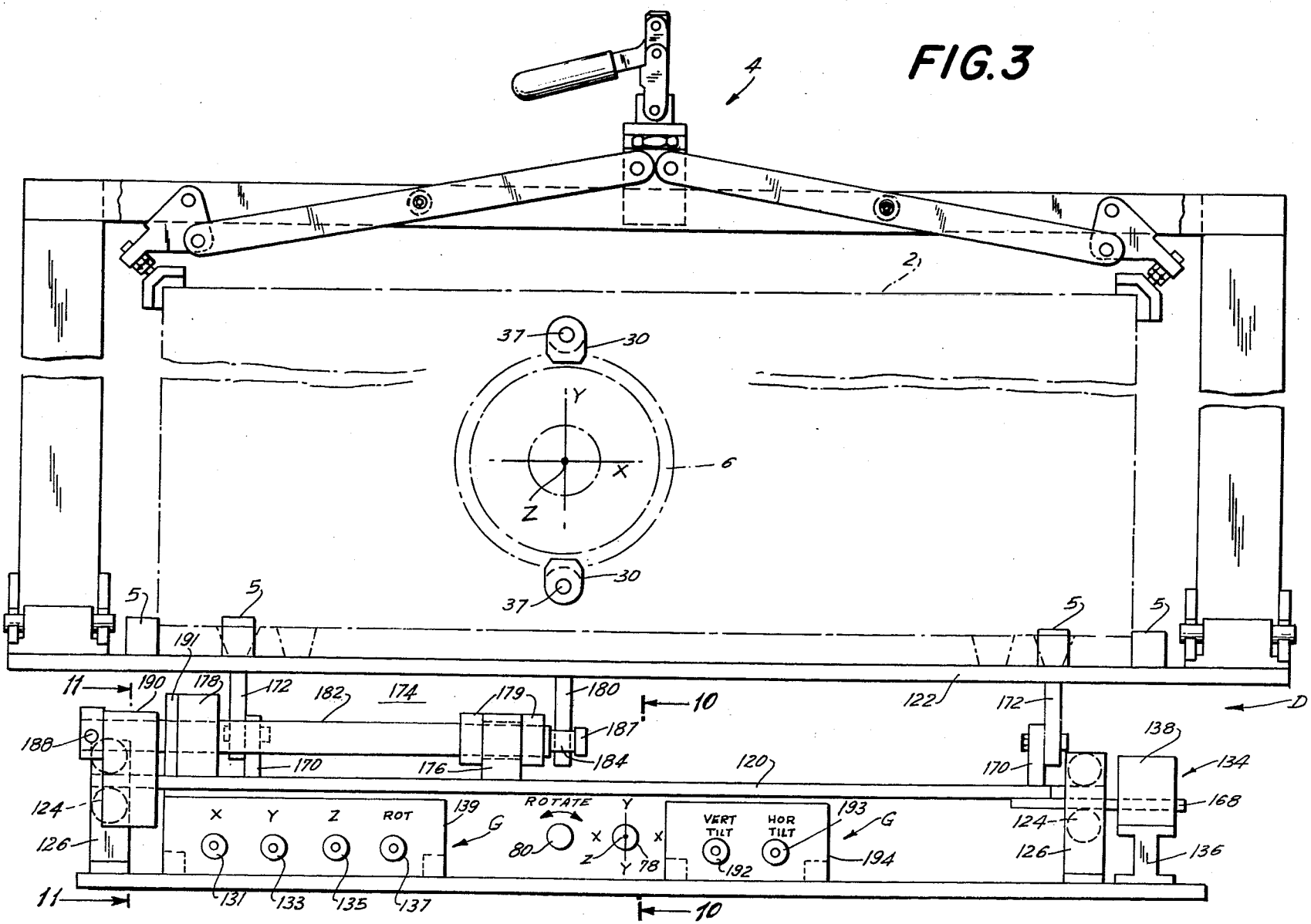
FIG. 3 is a front elevational view taken along line 3—3 of FIG. 2.

Release means G, best shown at the bottom of FIG. 3, is comprised of switches 131, 133, 135, and 137 secured in a panel 139 which are connected to valves (not shown) interposed in an air line (not shown) extending from a compressor (not shown) to each lock of locking means F. In one position of each switch, compressed air is prevented from reaching the corresponding piston chamber by the closed valve while in the other position the valve is opened so compressed air fills chamber 134 to cause movement of piston 140. Switches 131, 133, 135, and 137 permit movement in the *x*, *y* and *z* axes as well as rotational movement, repsectively. These valves are located near the front of tube A and adjacent tubes 78 and 80 in order to permit easy access for the technician as he is viewing the screen.

Figure 8:
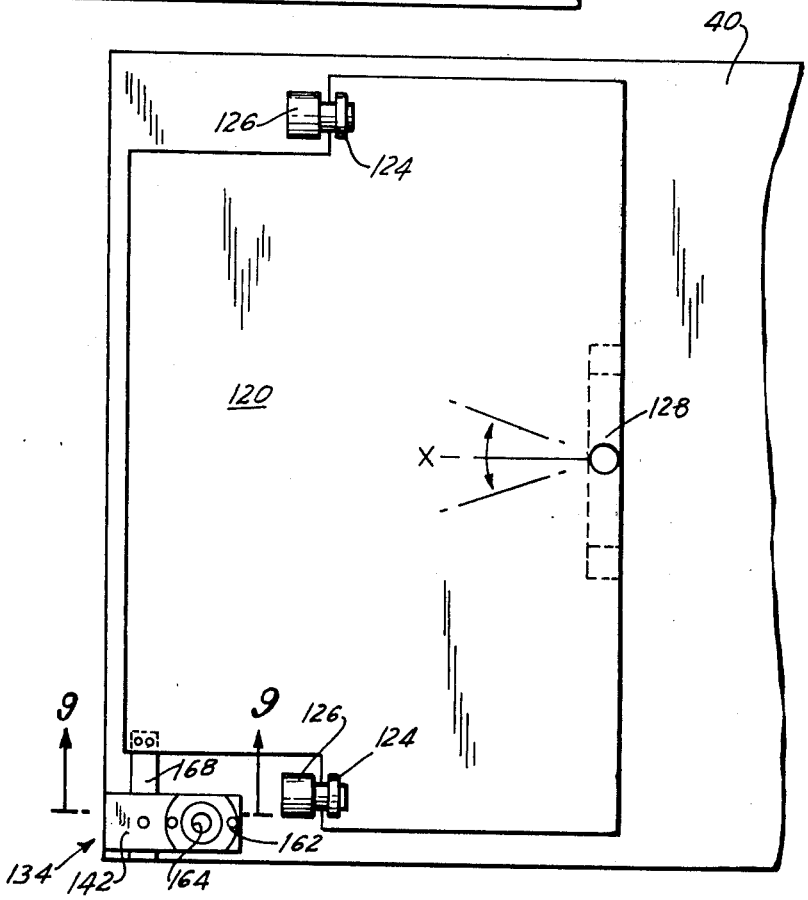
FIG. 8 is a view taken along line 8—8 of FIG. 7.

Though the above-described four different types of movements would be generally adequate to precisely adjust the yoke relative to the tube for a conventional yoke mounting apparatus, the more versatile apparatus of the present invention includes two additional types of movements. The present invention, as compared to prior yoke mounting schemes, has the capability of mounting a yoke to a tube while the tube is within its enclosure, a mentioned above. With particular reference to television tubes, one particular type of tube is often used with several different types of cabinets. Each cabinet has the tube mounted within it in a particular manner which may involve a certain angle between the respective *z* axis of the yoke and tube, as shown in FIG. 1. To enable the use of the present invention with a large variety of different types of television cabinets, a mechanism is needed to align these *z* axes. To this end a tilt apparatus D is provided to which the enclosure 2 is fastened. Tilt apparatus D is comprised of two plates 120 and 122 supported by base plate 40. Horizontal tilt plate 120 is movable between rollers 124 supported by bar 126 attached to base plate 40, as best seen in FIG. 8. Horizontal tilt plate 120 is supported at its back portion by a pivot 128 which is comprised of a bar to which plate 120 is secured by a retaining screw 130. Thus, plate 120 rests on wheels 124 at its front and on plate 128 at its back. Movement of plate 120 is done by grasping it at its front edge and moving it horizontally along axis *x*.

Figure 9:
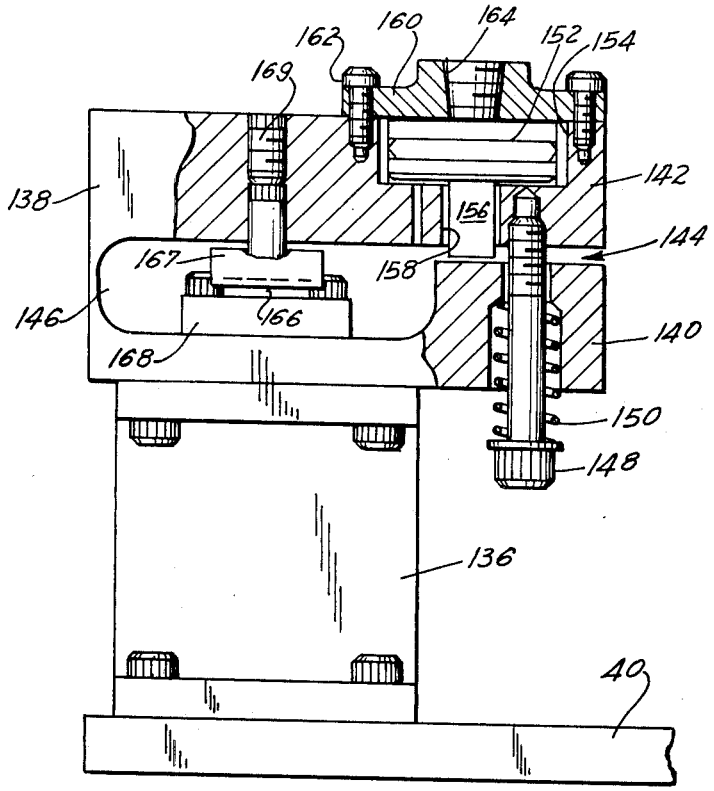
FIG. 9 is a view of the horizontal tilt lock taken along line 9—9 of FIG. 8.

A lock 134 is utilized to retain horizontal tilt plate 120 at a particular position. Its structure, as best seen in FIG. 9, differs slightly from the locks discussed above. An I-shaped bar 136 supports lock body 138. Bar 136 is fastened at the bottom to base plate 40 and at the top to body 138. Body 138 has two arms 140 and 142 separated by a small gap 144 at one end and by a recess 146 toward the other end. A screw 148 is inserted through a hole in arm 140 and threaded into a threaded hole in arm 142. A spring 150 biases arm 140 toward arm 142 to decrease the size of gap 144. A piston 152 is adapted to be received in a cylinder chamber 154 in arm 142 while the piston rod 156, attached to piston 152, is slidable within a hole 158 in arm 142. A bar 160 closes chamber 154 to retain piston 152 within the chamber. Screws 162 attach bar 160 to arm 142. Plate 160 includes a threaded hole 164 adaptable to receive a line from the same pneumatic source (not shown) discussed above. Within the recess 146 a disc 166, preferably made of synthetic rubber, is attached to a plate 167. Plate 167 is attached to a threaded shaft 169 which is screwed into arm 142. A bar 168, securely fixed to horizontal tilt plate 120, is adapted to enter recess 146 and extend into the space between disc 166 and arm 140. In its normal position, disc 166 will firmly press against bar 168 due to the action of spring 150 is biasing arms 140 toward arm 142. Consequently, bar 168 will be prevented from movement resulting in the locking in place of horizontal tilt plate 120. To release bar 168, compressed air (from a source not shown) is fed into cylinder chamber 154 to move cylinder 152 in the direction to cause piston rod 156 to press against arm 140 and compress spring 150. This separates arm 140 from 142 to increase the gap between disc 166 and arm 140. The means used to feed compressed air to the cylinder chamber 154 is a switch 193, mounted in panel 194, controlling a valve (not shown) which is a part of release means G.

Figure 10:
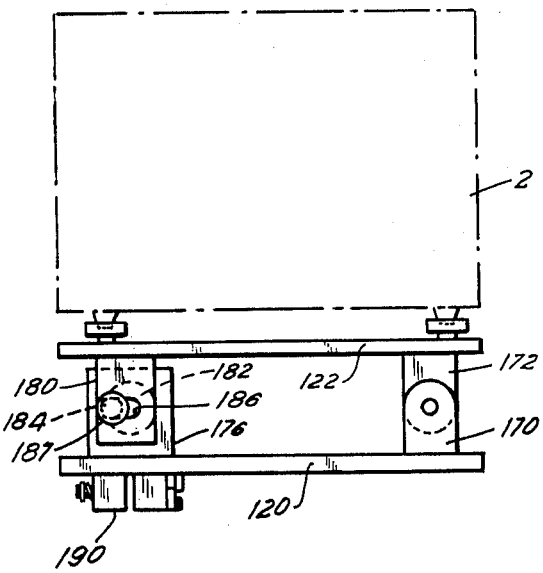
FIG. 10 is a fragmentary side view of the vertical tilt mechanism taken along line 10—10 of FIG. 3.

Vertical tilt plate 122 is supported by horizontal tilt plate 120. At the side of plate 122 beneath the back of tube A, a bar 170 attached to and extending up from plate 120 is rotatably mounted to a bar 172 attached to and extending down from bar 122 (see FIGS. 2, 3, 7, and 10). The attachment between bars 170 and 172 is such as to allow the tilting of plate 122 in the vertical direction. At the front of plate 122 is a vertical tilt assembly 174 (see FIG. 3). It is comprised of parts 176 and 178, attached to horizontal tilt plate 120, and part 180, attached to vertical tilt plate 122. Parts 176 and 178 are blocks, preferably containing ball bearings, adapted to rotatably receive a shaft 182. Collars 179 on either side of block 176 are fastened to shaft 182 by a screw (not shown) to keep shaft 182 from sliding. At the end of shaft 182 adjacent part 176, as best seen in FIG. 10, is an eccentric collar 184 which is adapted to be received within a groove 186 in part 180. A screw 187 retains a roller in place on the eccentric collar 184. At its other end, as best seen in FIG. 2, shaft 182 has an attached handle 188 which can be used to rotate the shaft. Thus, as handle 188 is rotated, eccentric collar 184 is correspondingly rotated. This results in the vertical movement of part 180 and, therefore, of vertical tilt plate 122.

To maintain vertical tilt plate 122 in a particular position, rotation of shaft 182 must be prevented. To this end, a lock 190 is attached by a plate 191 (similar to plate 110 discussed above) to part 178 and adapted to accommodate shaft 182. Lock 190 is identical to that shown in FIG. 11 and discussed above. In its normal state, lock 190 grips shaft 182 to keep it from rotating. To release lock 190, a switch 192, part of release means G and mounted in panel 194, is actuated to open a valve which allows compressed air to pass through to lock 190.

To describe the entire yoke mounting procedure, positioning means C is moved away from tube A along the z axis until yoke support B is completely outside enclosure 2. Handle 24 is raised to move eccentric cam 16 clockwise until arms 26 are sufficiently separated to admit yoke 6 between them. After yoke 6 is placed between wedges 30 and 32 on each arm 26, handle 24 is lowered until yoke 6 is gripped tightly. Positioning means C is then moved toward the tube along the *z* axis until yoke 6 is adjacent the tube. However, only holder B is near the yoke with the rest of the apparatus being sufficiently distant from the yoke so as to minimize its effect on the magnetic field. Tube A and yoke 6 can be connected to the circuitry in the enclosure with which they will eventually be used, or to a remote circuit. The former is preferred since the yoke adjustment can be made relative to the components of the actual in-service circuit and compensating for its manufacturing tolerances. A skilled technician views the screen and aligns the respective *z* axes of the yoke and tube by operating tilt mechanism D. This having been done, yoke support B can then be rotated or moved by positioning means C to provide an accurate image on the tube screen. With the position of the yoke and tube being properly adjusted, yoke 6 remains in this position, due to locking means F, until it is secured, usually by a wax or plastic, to the tube. Handle 24 is raised to separate the yoke holder from the yoke and the apparatus is readied for the next operation.

To facilitate the vertical movement of positioning means C, a counterweight 114 is provided. Counterweight 114 slides along a guide rod 115 which is attached between bars 56. Another bar 118 is also attached to plate 116 and supports a wheel 120. Another wheel 121 is supported atop bar 68. A string 122 extends from an eyelet 124 on bar 68 to an eyelet 125 on counterweight 114. The weight of counterweight 114 is approximately that of all the parts capable of moving along the *y* axis. Thus, the technician need not overcome any appreciable weight in moving the yoke 6 vertically.

It should be noted that should a readjustment of the yoke become necessary after it has been fixed to the tube, the tube need not be removed from the enclosure. The apparatus is merely fastened to the yoke and heat is applied to melt the wax or plastic. The yoke is then adjusted exactly as described above. Considerable time, labor and expense are thereby saved.

The apparatus described above is well suited to precise adjustment of a yoke relative to a cathode ray tube by a technician who is doing the adjustment while simultaneously watching the tube screen. However, an additional desirable feature of this apparatus is that it automatically firmly maintains the yoke in the best position determined by the technician and prevents any inadvertent movement. The lock system is particularly well suited for this purpose and rigidly maintains the yoke in position until it is fixed to the tube by conventional means, such as wax.

It will be apparent from the foregoing that the advantages of the present invention are achieved by a positioning means which normally keeps a deflection yoke locked in position relative to a cathode ray tube. The yoke can only be moved from this position by actively releasing the lock controlling movement in one particular direction. Movement of the yoke is done manually as the technician is viewing the tube screen and consequently all the controls for the apparatus are positioned at the front of the tube. The portion of the apparatus supporting the yoke is elongated so that it can extend into a relatively small enclosure to enable mounting of the yoke to a tube already within its cabinet and attached to its in-service circuitry. Furthermore, this arrangement keeps the magnetic parts of the magnetic apparatus well away from the yoke to prevent any changes in the magnetic field.

While but a single embodiment of the present invention has been here specifically disclosed, it will be apparent that may variations may be made therein, all within the scope of the instant invention as defined in the following claims:

I claim:

1. A device for relatively positioning a deflection yoke and a cathode ray tube to permit precise mounting of the yoke on the tube while the tube is situated in an enclosure, said device comprising an elongated yoke holding member, means for adjustably positioning said member relative to said tube, said means being located externally of the enclosure, said member being mounted on said means and extending outwardly therefrom and adapted to be positionable by said means to a point within said enclosure adjacent said tube, and control means operably connected to said position adjusting means and effective when actuated to adjust the position of said member.

2. The device of claim 1, wherein said member is comprised of at least one cantilever mounted at one end on said positioning means and having yoke receiving parts at its other end.

3. The device of claim 1, further comprising a locking means to normally lock said position adjustable means at a particular position, and a release means operatively connected to said locking means and effective when actuated to release said locking means to permit movement of said position adjustable means.

4. The device of claim 3, wherein at least a portion of said release means is positioned at a location near the front of said tube, with at least a portion of said control means extending to said location.

5. The device of claim 1, further comprising a support upon which the enclosure may be received, means operably connected to said support for adjustably positioning said support relative to said member and control means operably connected to said support positioning means and effective, when actuated, to adjust the position of said support relative to said member.

6. The device of claim 5, wherein said adjustable positioning means is movable vertically and horizontally relative to said member.

7. The device of claim 5, wherein at least a portion of said adjustable support positioning means is rotatable about a horizontal axis.

8. The device of claim 7, further comprising a locking means to normally lock said adjustable support positioning means at a particular positon about said horizontal axis, and a release means operably connected to said locking means and effective when actuated to release said locking means to permit the movement of said adjustable support positioning means.

9. The device of claim 8, wherein said adjustable support positioning means is rotatable about a vertical axis.

10. The device of claim 9, further comprising a locking means to normally lock said adjustable support positioning means at a particular position about said vertical axis, and a release means operably connected to said locking means and effective when actuated to release said locking means to permit the movement of said adjustable support positioning means.

11. The device of claim 5, wherein said adjustable support positioning means is rotatable about a vertical axis.

12. The device of claim 11, further comprising a locking means to normally lock said adjustable support positioning means at a particular position about said vertical axis, and a release means operably connected to said locking means and effective when actuated to release said locking means to permit the movement of said adjustable support positioning means.

13. The device of claim 5, wherein said adjustable support positioning means comprises: a plate having one end rotatably supported about a vertical axis with an opposite end being movable horizontally, and another plate having one end rotatably supported about a horizontal axis with an opposite end being movable vertically, with one of said plates being supported by the other and comprising at least a portion of said support.

14. The device of claim 13, further comprising a locking means to normally lock said horizontally movable plate and said vertically movable plate, respectively, at a particular position, and a release means operably connected to said locking means and effective when actuated to release said locking means to permit the movement of said adjustable support positioning means.

15. The device of claim 14, wherein at least a portion of said release means is positioned at a location near the front of said tube, and at least a portion of said support control means also being positioned at said location.

16. The device of claim 5, further comprising a locking means to normally lock said adjustable support positioning means at a particular position, and a release means operably connected to said locking means and effective when actuated to release said locking means to permit the movement of said adjustable support positioning means.

17. The device of claim 16, wherein at least a portion of said release means is positioned at a location near the front of said tube, and at least a portion of said support control means also being positioned at said location.

18. The device of claim 5, wherein said support positioning means comprises a base, at least a pair of relatively movable parts, one of said parts being operatively connected to said base, the other of said parts being operably connected to said member, locking means normally preventing relative movement between said parts and release means operatively connected to said locking means and effective when actuated to release said locking means to permit relative movement between said parts.

19. The device of claim 18, wherein said support control means is operatively connected to one of said relatively movable parts.

20. The device of claim 1, wherein said position adjustable means comprises a base, a pair of relatively movable parts, one of said parts being operatively connected to said base, the other of said parts being operably connected to said member, locking means normally preventing relative movement between said parts and release means operatively connected to said locking means and effective when actuated to release said locking means to permit relative movement between said parts.

21. The device of claim 20, wherein said control means is operatively connected to one of said parts.

22. The device of claim 20, wherein said locking means comprises clamp means connected to one of said parts and having a recess therein, said other of said parts extending within said recess, and biasing means normally urging said clamp means to engage said other of said parts within said recess.

23. The device of claim 22, wherein said clamp means comprises a body and a pair of spaced arms extending therefrom, said recess being defined by said arms and said body.

24. The device of claim 23, wherein said biasing means comprises spring means for urging said arms towards each other such that said other of said parts is secured within said recess.

25. The device of claim 23 further comprising a pneumatic chamber in one of said arms, a piston movably mounted in said chamber and a piston rod operatively interposed between said piston and said other arm.

26. The device of claim 25, wherein said release means comprises a pneumatic source and means operably connecting said source to said chamber, when actuated, such that said piston is moved to cause said rod to separate said arms.

27. The device of claim 26, wherein said control means is comprised of an elongated part operably connected to said first, second and third parts, and another elongated part operably connected to said rotatably mounted member.

28. The device of claim 1, wherein said positioning means is comprised of movement means enabling movement of said member along three axes, each axis being perpendicular to the other two.

29. The device of claim 28, further comprising a locking means to normally lock said position adjustable means at a particular position along any of said three axes, and a release means operably connected to said locking means and effective when actuated to release said locking means to permit the movement of said movement means along any of said three axes.

30. The device of claim 29, wherein said control means is comprised of an elongated part operably connected to said movement means and extending to a location near the front of said tube, and wherein at least a portion of said release means is positioned at said location.

31. The device of claim 28, wherein said movement means is comprised of a horizontal carriage adapted to extend longitudinally of the axis of said tube, a first part movably positioned thereon for movement along said axis, said first part adapted to extend laterally of said tube, a second part movably positioned on said first part for horizontal movement substantially perpendicular to said axis, said second part extending vertically, and a third part movably positioned on said second part in a vertical direction substantially perpendicular to said axis.

32. The device of claim 31, further comprising a locking means to normally lock each of said first, second and third parts relative to said carriage, said first part, and said second part, repectively and a release means operably connected to said locking means and effective when actuated to release said locking means to permit movement of said first, second and third parts relative to said carriage, said first part and said second part.

33. The device of claim 28, wherein said member is adapted to surround the axis of said tube and is rotatably mounted on said movement means for rotation about said axis.

34. The device of claim 33, wherein said control means is comprised of another elongated part operably connected to said member and extending to said location.

35. The device of claim 33, wherein said positioning means further comprises a locking means to lock said movement means at a particular position along any of said three axes and to lock said member at any angle of rotation, and a release means operably connected to said locking means and effective when actuated to release said locking means to permit the movement of said movement means along any of said three axes and to permit the rotation of said member.

36. The device of claim 35, wherein said control means further comprises an elongated part operably connected to said movement means and another elongated part connected to said member.

37. The device of claim 36, wherein said member and said positioning means, except for at least a portion of said release means, are adapted to be positioned behind said tube, the at least a portion of said release means being posititoned at a location near the front of said tube, and both said elongated parts extending to the said location.

38. A locking device for preventing movement between two relatively movable parts in a position adjustable yoke holding member of a cathode ray tube yoke positioning apparatus, comprising: a body connected to one of said parts, a pair of spaced arms extending from said body and defining, with said body, a recess into which the other of said parts extends, means normally biasing said arms towards each other to clamp the other of said parts in said recess and pneumatically controlled means effective, when actuated, to separate said arm to release the other of said parts from said recess.

39. The device of claim 38, wherein said pneumatically controlled means comprises a pneumatic cylinder in one of said arms, a piston movably mounted within said cylinder, a piston rod interposed between said piston and the other of said arms, a pneumatic source, and means operably connecting said source to said chamber such that said source to said chamber such that said source is operative to move said piston to cause said rod to separate said arms.

* * * * *